US006267338B1

(12) United States Patent
Saylor et al.

(10) Patent No.: US 6,267,338 B1
(45) Date of Patent: Jul. 31, 2001

(54) SUPPORT RAIL ASSEMBLY FOR OFFICE ACCESSORIES

(75) Inventors: Charles Saylor, Grand Rapids; Robert Wayner, Holland; David Byrne, Jenison; Kevin L. Brinks; Ricky D. Roels, both of Holland; Cheryl C. Compton, Grand Haven, all of MI (US); Sheldon Phillips, Thousand Oaks; Edward Mitchell, Los Angeles, both of CA (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 09/304,162

(22) Filed: Apr. 30, 1999

(51) Int. Cl.[7] ..... F16M 11/00; A47B 23/00

(52) U.S. Cl. ..... 248/200; 248/298.1; 211/94; 108/44

(58) Field of Search ..... 248/200, 121, 248/122.1, 126, 201, 231.61, 231.71, 298.1; 211/94.01, 162, 133.1; 108/44

(56) References Cited

U.S. PATENT DOCUMENTS

| | | | | |
|---|---|---|---|---|
| D. 333,489 | | 2/1993 | Stern et al. . | |
| 401,553 | | 4/1889 | Godfrey . | |
| 1,039,554 | | 9/1912 | Lindhorst . | |
| 1,830,347 | * | 11/1931 | Camden et al. | 182/222 |
| 2,551,157 | | 5/1951 | Price . | |
| 2,979,155 | * | 4/1961 | Scharfenberger | 108/137 |
| 4,126,230 | | 11/1978 | Tyson et al. . | |
| 4,317,416 | | 3/1982 | Baum et al. . | |
| 4,323,291 | | 4/1982 | Ball . | |
| 4,709,891 | | 12/1987 | Barnett . | |
| 4,852,500 | | 8/1989 | Ryburg et al. . | |
| 4,869,378 | * | 9/1989 | Miller | 211/94 |
| 4,879,955 | | 11/1989 | Moll et al. . | |
| 4,884,513 | | 12/1989 | Newhouse et al. . | |
| 4,899,971 | * | 2/1990 | Elkin | 248/225.1 |
| 4,938,442 | | 7/1990 | Mastrodicasa . | |
| 4,948,205 | | 8/1990 | Kelley . | |
| 4,974,913 | | 12/1990 | Vogt et al. . | |
| 4,993,785 | | 2/1991 | Dunand . | |
| 5,048,698 | | 9/1991 | Konrad . | |
| 5,057,039 | | 10/1991 | Persing et al. . | |
| 5,103,741 | | 4/1992 | Grund et al. . | |
| 5,121,698 | | 6/1992 | Kelley . | |
| 5,154,126 | | 10/1992 | Newhouse et al. . | |
| 5,429,252 | | 7/1995 | Liu . | |
| 5,486,042 | | 1/1996 | Heisler et al. . | |
| 5,873,311 | * | 2/1999 | Schlattl | 108/44 |
| 5,937,766 | * | 8/1999 | Denny | 108/44 |

FOREIGN PATENT DOCUMENTS

| | | |
|---|---|---|
| 680414 | 8/1992 | (CH) . |
| 86 29 967 | 2/1987 | (DE) . |

* cited by examiner

*Primary Examiner*—Anita M. King
(74) *Attorney, Agent, or Firm*—Flynn, Thiel, Boutell & Tanis, P.C.

(57) ABSTRACT

A support rail assembly for positioning work-related accessories adjacent a worksurface such as a table. The rail assembly includes a horizontally elongated rail supported in upwardly spaced relationship from the worksurface by a support arm or stanchion. The rail defines therein an elongate slot which permits the mounting of accessories in various positions on the rail which are convenient to the user. The rail is supportable from either the rear edge of a worksurface or may be cantilevered forwardly from a wall adjacent the worksurface or from a wall panel to which the worksurface is attached.

34 Claims, 9 Drawing Sheets

SUPPORT RAIL ASSEMBLY FOR OFFICE ACCESSORIES

FIELD OF THE INVENTION

This invention relates to a support rail assembly for mounting along the edge of a worksurface such as a table, or for mounting on an upright panel or wall adjacent the worksurface, which support rail assembly is adapted to mount thereon various work-related accessories in a location convenient to the user.

BACKGROUND OF THE INVENTION

The modern office environment has ever increasing demands with respect not only to the availability of effective work space particularly in association with a worksurface, but also the efficient or effective utilization of space around a worksurface. The demands and space requirements for computers and telecommunication equipment, as well as the demands for various office tools or accessories which are typically supported on the top of a worksurface, generally result in excessive clutter on the worksurface thus limiting the available work space. In an effort to increase the available work space, attempts have been made to position many of the accessories or tools on adjacent supporting elements, such as by mounting the accessories on an adjacent wall. This alternative not only renders the wall structure more complex, but is not available in those situations where the worksurface is not disposed adjacent a wall. As a further alternative, some worksurfaces or table tops are provided with upright structures secured along the rear edge of the worksurface which project upwardly so as to provide additional storage compartments and the like, although even this alternative greatly increases the overall complexity of the worksurface arrangement and in particular significantly interferes with openness and visibility around the worksurface, thereby severely interfering either with aesthetics or team working functions.

Constructions of this latter type also typically have little flexibility or adjustability.

In recognition of the disadvantages associated with conventional structures of the type briefly summarized above, the present invention relates to a support rail assembly which includes a generally horizontally elongated rail supported in upwardly spaced relationship from the worksurface by one or more upright support arms or stanchions, but alternatively can be supported from an adjacent wall or panel. The rail extends generally along the rear edge of the worksurface and defines therein a pair of slots which open outwardly through a common access opening or mouth. Various tools or accessories are readily mountable on or removable from the rail via the slots and mouth therein, and can be positioned essentially at any desired location longitudinally along the rail so as to greatly facilitate the convenient use thereof. In addition, the various accessories, such as document supporting trays, may be mounted on the rail at an angle with respect to the worker to provide optimum visibility of documents or other items supported thereon.

The present invention also relates to a support rail assembly including an elongated rail adapted for mounting an accessory thereon and a support arm connected to the worksurface for stationarily positioning the rail above the worksurface and generally along the rear edge portion thereof. The support rail assembly includes a mounting arrangement which enables the rail to be slidably and sidewardly mounted on the support arm to releasably but fixedly secure the rail thereto.

Further, the present invention relates to a support rail assembly including an elongated rail adapted for mounting an accessory thereon and an upright support arm having an upper end releasably connected to the rail to position same above the worksurface. The support rail assembly additionally includes a mounting arrangement for securing the support arm and rail to the worksurface, the mounting arrangement having a first leg portion which overlies the support arm and a second leg portion which projects under the worksurface. The first leg portion defines therein a slot which cooperates with a pin member which projects outwardly from the support arm and a fastening member is associated with the second leg portion and is adjustable to wedge the pin in the slot and fixedly but releasably secure the support arm and rail to the worksurface.

The desirable constructional and functional features of the present invention, as well as other operational advantages thereof, will be apparent upon reading the following specification and inspecting the accompanying drawings.

Figures 1, 7:
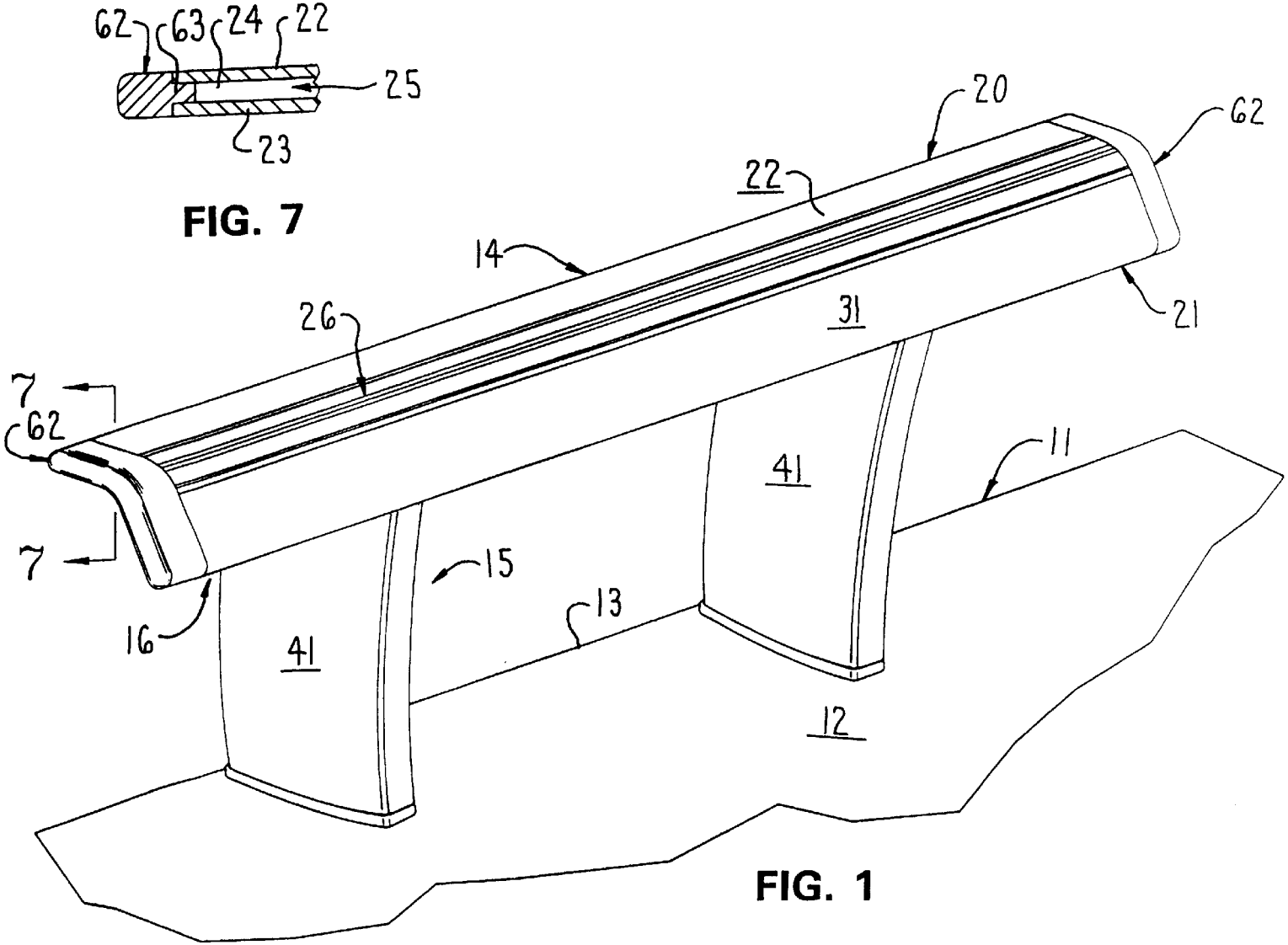
FIG. 1 is a perspective view which illustrates a fragment of a horizontally enlarged worksurface having a support rail assembly according to the invention mounted at a rear edge thereof.
FIG. 7 is an enlarged cross-sectional view of an end cap taken generally along line 7—7 in FIG. 1.

Certain terminology will be used in the following description for convenience in reference only, and will not be limiting. For example, the words "upwardly" and "downwardly", "rightwardly" and "leftwardly" will refer to directions in the drawings to which reference is made. The word "front" will also be used to refer to the edge of the worksurface adjacent the worker and "rear" will refer to the edge which is normally remote from the worker. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
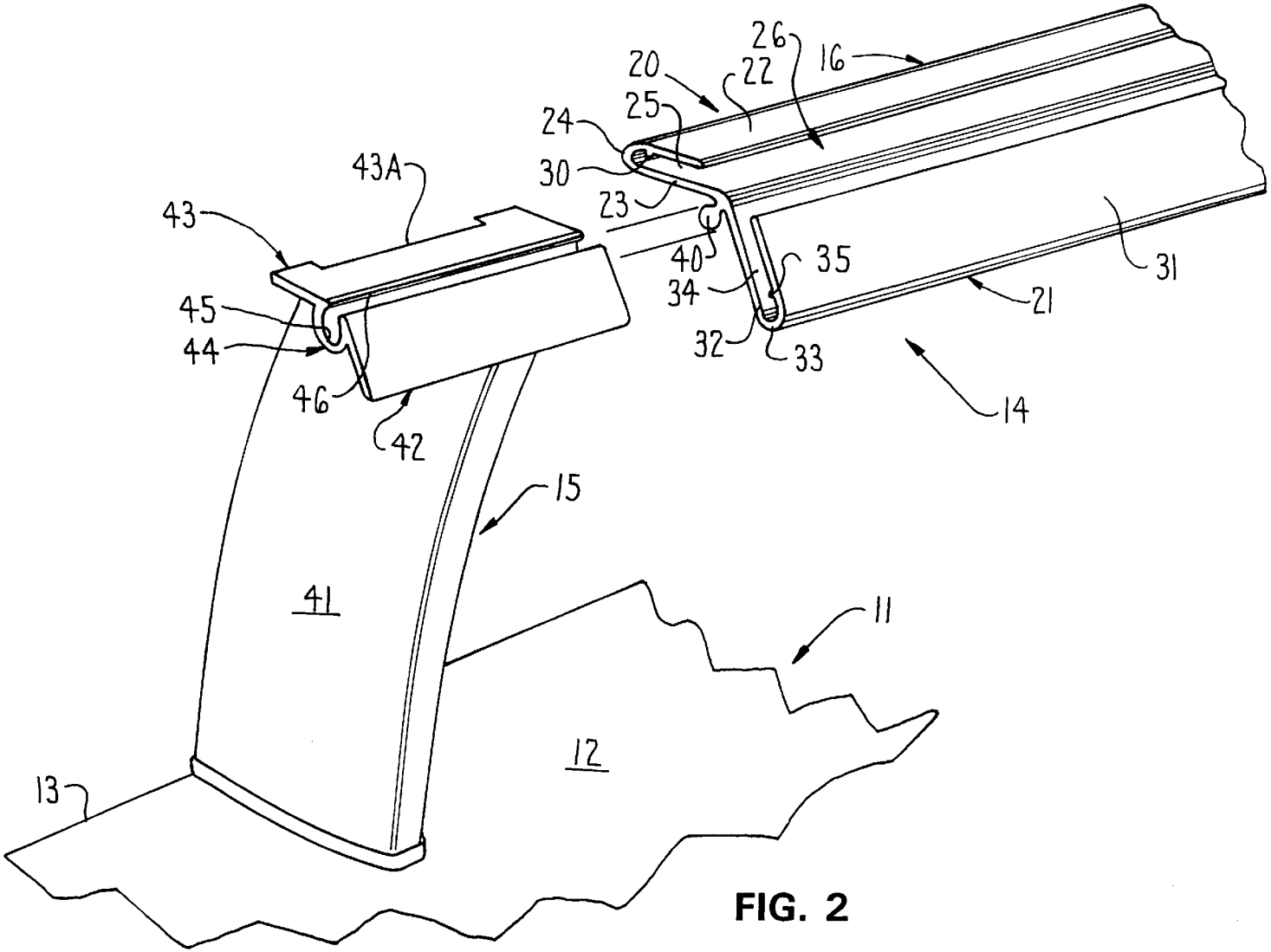
FIG. 2 is a fragmentary, exploded perspective view similar to FIG. 1 depicting the slidable mounting of the rail with a support arm.
Figure 3:
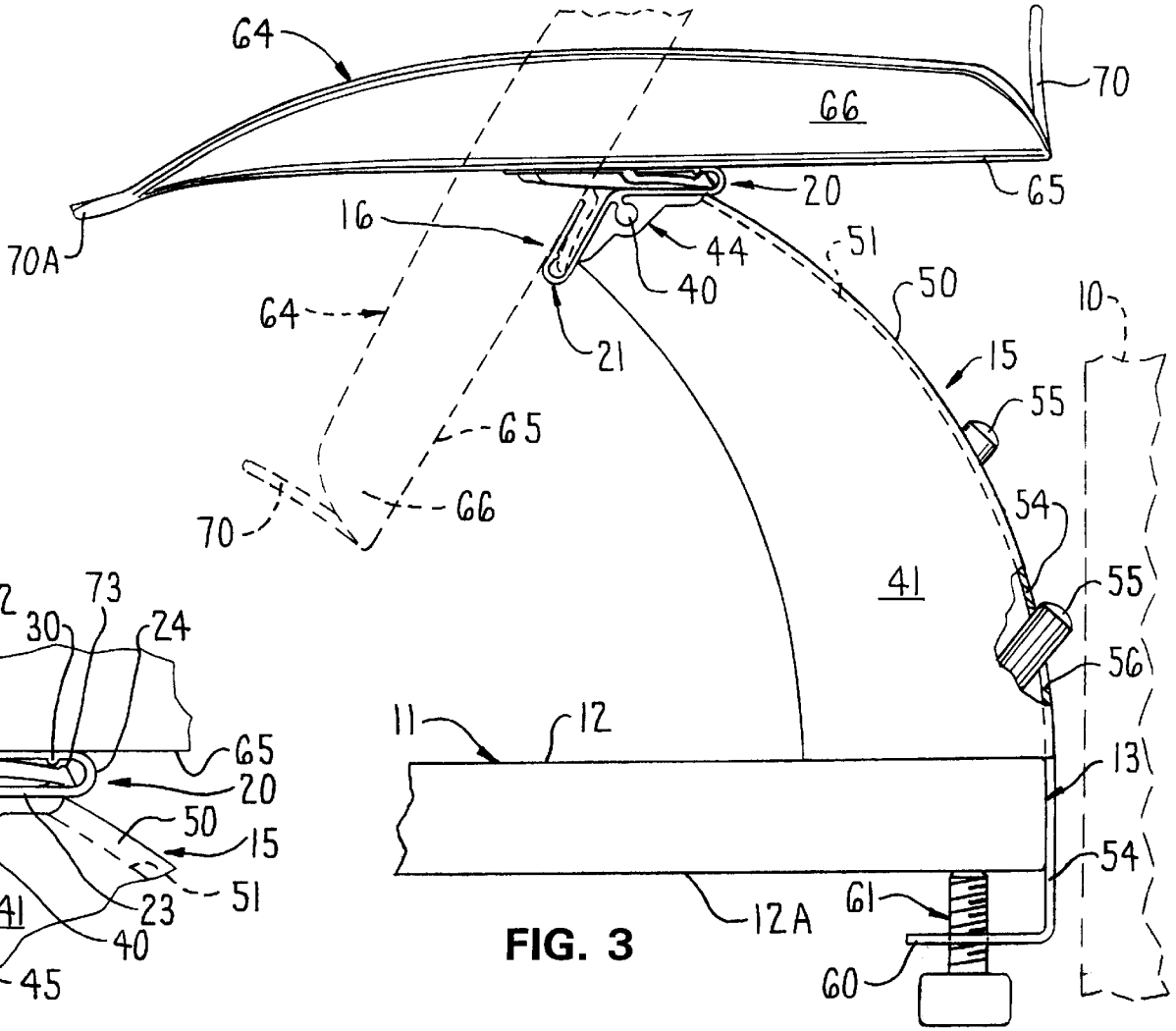
FIG. 3 is a fragmentary, end elevational view showing a document support tray mounted on the rail and additionally showing the rail mounted on the worksurface.

Referring to the drawings, and particularly FIGS. 1–3, there is illustrated part of a generally horizontally oriented worksurface 11. The worksurface 11 defines thereon an enlarged and generally horizontal upper surface 12, with the worksurface 11 terminating in a longitudinally extending rear edge 13 which is remote from the side of the worksurface 11 which is normally closest to the worker. The worksurface 11 can be provided with legs (not shown) so as to function as the top of a table, or can be mounted on support arms which project outwardly from a wall 10 (shown in dotted lines in FIG. 3) which would be positioned closely adjacent the rear edge 13 of the worksurface 11. The worksurface 11 mounts thereon a support rail assembly 14 adjacent the rear edge 13. The support rail assembly 14 includes one or more support arms or stanchions 15 which mount on and project upwardly from the worksurface 11 and support a generally horizontally elongate support rail 16 adjacent the upper end thereof, which rail 16 is disposed in upwardly spaced relation from the worksurface 11 and extends generally longitudinally parallel to the rear edge 13 thereof.

The support rail 16 is of a generally shallow and inverted V-shape configuration in transverse cross-section, and includes a rear leg 20 which is generally horizontal in the front-to-back direction of the worksurface 11 (FIG. 3). This rear leg 20 in turn is joined to a front leg 21 which, as it projects forwardly from its junction with the rear leg 20, is angled downwardly so that the legs 20 and 21 define the shallow V-shape configuration. The rear leg 20 is defined by generally parallel and horizontal top and bottom walls 22 and 23, respectively, the latter being joined by a curved edge wall 24 at the rearward edges thereof. The walls 22 and 23 are vertically spaced so as to define a narrow slot 25 therebetween. This slot 25 extends lengthwise throughout the horizontal length of the rail 16 and in addition opens horizontally forwardly so as to terminate at a mouth 26. The top wall 22, on the bottom surface thereof, is provided with a small, downwardly projecting rib 30 which extends lengthwise of the rail and is disposed closely adjacent the rear closed end of the slot 25 for a purpose to be explained hereinafter.

The front leg 21 of the support rail 16 is of similar construction in that it is defined by spaced-apart and substantially parallel top and bottom walls 31 and 32, respectively, which are joined at their front edges by a curved edge wall 33. These walls thus define a slot 34 therebetween which extends lengthwise throughout the rail 16, and opens generally rearwardly through the mouth 26. The slot 34 preferably extends at an angle relative to both the horizontal and the vertical, whereas the slot 25 extends horizontally. The top wall 31, on the inner surface thereof, is also provided with a small rib 35 which extends lengthwise of the rail 16 and projects downwardly therefrom in the vicinity of the closed rear end of the slot 34.

It will be appreciated that the included angle defined by the front and rear legs 20 and 21 is preferably greater than 90° and may be between about 100° and about 130°, and in the illustrated embodiment is about 115°. The above angular values are presented only by way of example and other angles are within the scope of the invention.

The support rail 16 also has a rib 36 (FIG. 4) extending lengthwise thereof along the undersurface of the rail 16 substantially at the apex of the V as defined by the bottom walls 23 and 32. This rib 36 is of narrow width and projects outwardly only a limited extent, and at its outer end is joined to a lengthwise extending mounting rod 40 which is of increased cross-sectional size as compared to rib 36, and extends along substantially the entire length of the rail 16. The mounting rod 40 in the illustrated embodiment is generally cylindrical in cross-section.

Figure 4:
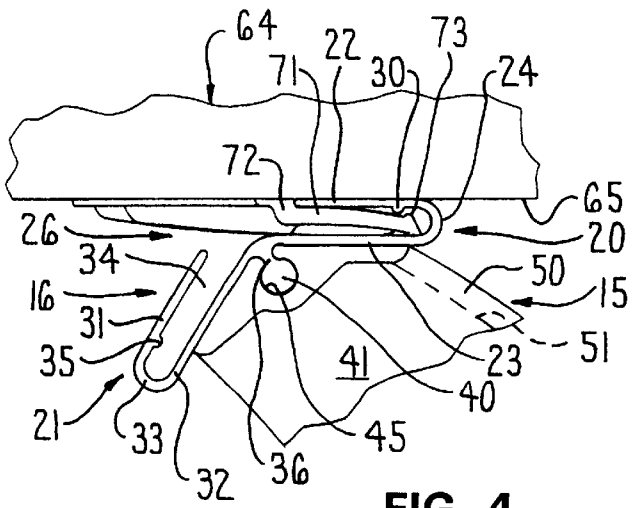
FIG. 4 is an enlarged, fragmentary view which illustrates the area of engagement between the document support tray and the support rail.
Figure 5:
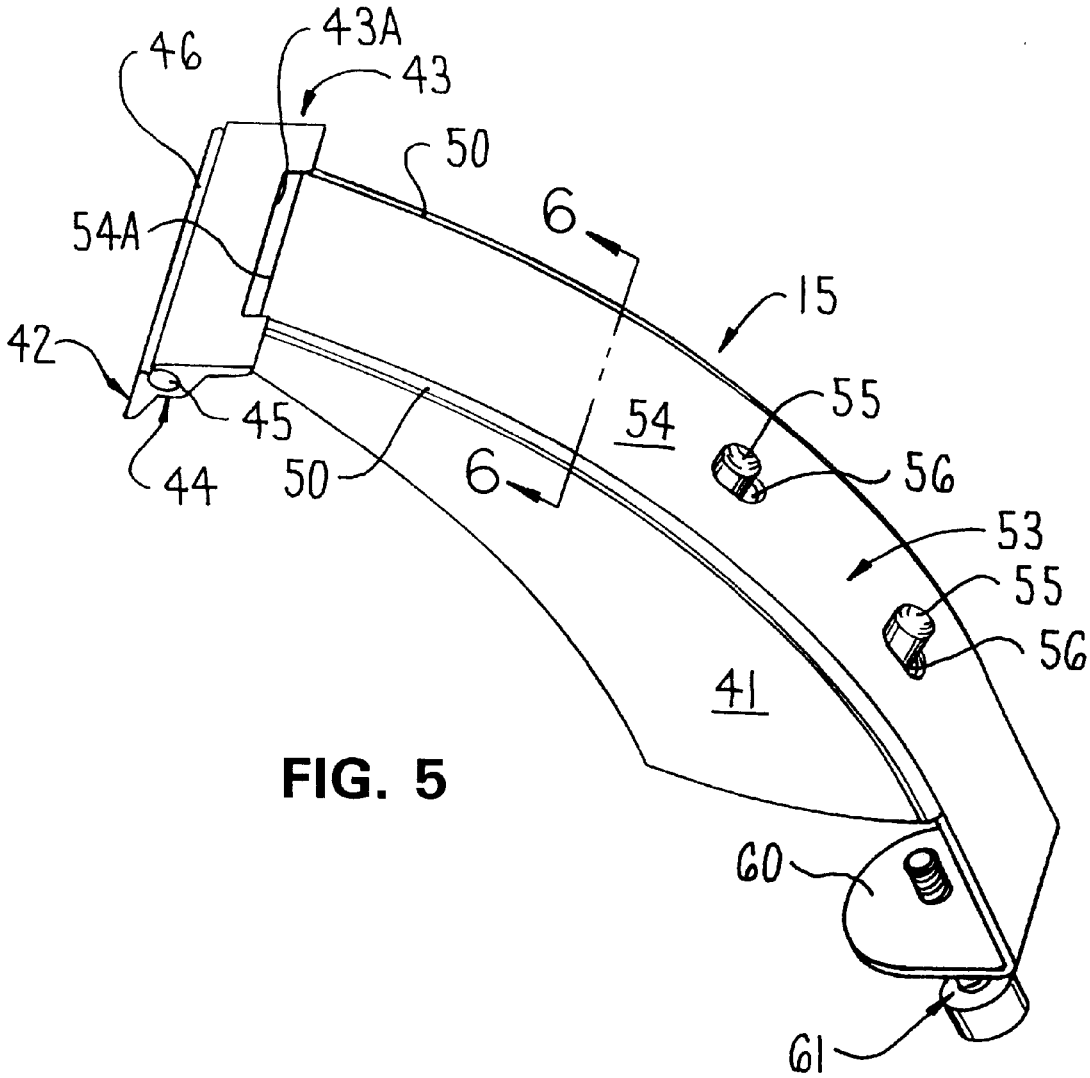
FIG. 5 is a perspective view of the support arm and mounting arrangement.

With reference to FIGS. 2–4, the support rail 16 is supported in upwardly spaced relation along the rear edge 13 of the worksurface 11 by at least one, and typically two or more, support arms or stanchions 15. In the illustrated embodiment, the support arm 15 includes a main tower or body part 41 which bears on the upper surface 12 of the worksurface 11, and is cantilevered upwardly therefrom. This main body part 41 at its upper end terminates in front and rear support plates 42 and 43, respectively, which are angled with respect to one another and have upper surfaces which supportingly bear directly under the respective rail bottom walls 32 and 23 of rail 16. Rear support plate 43, as best shown in FIGS. 2 and 5, defines therein a generally rectangular and rearwardly opening recess 43A.

The body part 41 additionally includes a generally cylindrical guide tube 44 fixed thereto and extending generally horizontally and in parallel relationship with the rear edge 13 and the lengthwise extent of support rail 16. The guide tube 44 defines therein a longitudinally extending and generally cylindrical channel or slot 45 which opens upwardly at an elongate and narrow access opening 46 defined by the opposed inner longitudinal edges of the front and rear support plates 42 and 43, and which slot 45 is also open at both ends. In the illustrated embodiment, the slot 45 has a generally circular cross-section.

To secure the rail 16 and body part 41 together, the mounting rod 40 is sidewardly inserted into one of the open ends of slot 45 of guide tube 44 so as to be snugly supported therein, whereupon the rib 36 projects through the access opening 46 so that the bottom walls 32 and 23 of the front and rear legs 21 and 20 are thus positioned for respective engagement with the front and rear support plates 42 and 43.

It will be appreciated that the rod 40 may alternatively be provided on body part 41 between support plates 42 and 43 so as to project upwardly therefrom, and that the guide tube 44 may be provided along the underside of rail 16 so as to open downwardly.

With reference to FIG. 3, the body part 41 has a generally arcuate profile when viewed from an end thereof so as to project forwardly from the rear edge 13 of the worksurface 11 toward the front edge thereof.

Figure 6:
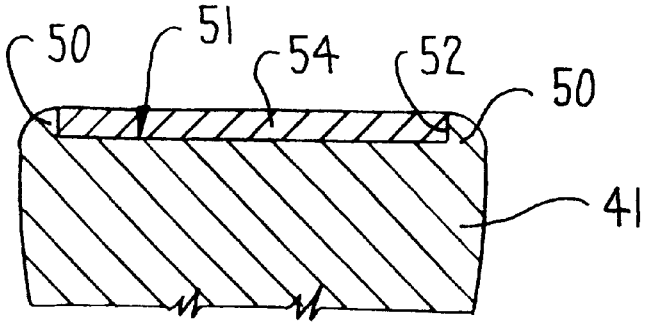
FIG. 6 is an enlarged cross-sectional view taken generally along line 6—6 in FIG. 5.

With reference to FIGS. 5 and 6, the body part 41 includes a pair of generally parallel flanges 50 which project upwardly and extend along the rear side edges of body part 41. The flanges 50, along with an outwardly facing rear surface 51 (shown in dotted lines in FIGS. 3 and 4) of body part 41 together define a channel or recess 52 which extends along rear side of body part 41 for a purpose as discussed below.

The body part 41 is secured to the worksurface 11 by a generally L-shaped mounting part 53 (FIGS. 3 and 5). Mounting part 53 includes a generally vertically oriented leg 54 which is disposed in recess 52 between flanges 50 of body part 41 (FIG. 6), with the upper terminal edge 54A of leg 54 partially projecting into recess 43A of rear support plate 43. In this regard, the flanges 50 project outwardly from rear surface 51 by an amount similar to the thickness dimension of leg 54. Leg 54 overlies and is fixedly but removably secured to the rear surface 51 of body part 41 and has a shape which conforms to the generally arcuate configuration of rear surface 51. This securing of leg 54 to body part 41 is accomplished by at least one, and in the illustrated embodiment, a pair of generally cylindrical pins 55 securely mounted within body part 41 and having upper ends which project from the rear surface 51 of body part 41. The upper ends of pins 55 engage in correspondingly located and slightly elongated slots 56 which extend completely through leg 54 so as to permit fixed coupling of leg 54 to body part 41.

The vertical leg 54 extends downwardly so as to overlie the rear edge 13 of the worksurface 11 and has a small thickness which is a small fraction of the width of main body part 41 (as measured from front-to-rear) such that the rearward projection of the mounting arrangement is minimal. In one embodiment of the invention, the rearward projection of mounting arrangement is about equal to or less than one inch as measured rearwardly from the rear edge 13 of worksurface 11. The vertical leg 54 at its lower end terminates in and is rigidly joined to a generally horizontally projecting forward leg 60 which projects partially under the worksurface 11, and in the illustrated embodiment is spaced downwardly from the bottom 12A thereof. This forward leg 60 mounts thereon a manually adjustable fastening member 61, the latter being threadingly engaged with the forward leg 60 and at its lower end has an enlarged knob which can be manually gripped, or gripped by a tool, so as to enable the upper end of the fastening member 61 to move into clamping engagement with the bottom 12A of the worksurface 11 upon rotation of fastening member 61. This rotation of fastening member 61 exerts a downwardly directed force on legs 54 and 60 which serves to wedge the pins 55 against the upper edges of the respective slots 56 so as to secure the body part 41 tightly against the upper surface 12 of the worksurface 11.

The support arm 15 can be detached from the worksurface 11 by loosening fastening member 61 so as to disengage same from the underside 12A of the worksurface 11, and sliding the mounting part 53 slightly upwardly relative to the rear surface 51 of body part 41 to disengage the pins 55 from the upper edges of the respective slots 56 so as to allow pins 55 to pass therethrough as the mounting part 53 is moved away from the body part 41.

As shown in FIGS. 1 and 7, the opposite ends of the support rail 16 may be provided with a finished appearance by providing end caps 62 at the terminal ends of the rail 16. End caps 62 each include a generally horizontally extending V-shaped projection 63 which extends sidewardly into the sidewardly oriented open ends of the respective slots 25 and 34. The projections 63 include correspondingly located grooves therein (not shown) to accommodate ribs 30 and 35.

The rail 16 in the illustrated embodiment is formed in one piece, such as by being formed from a metal plate (for example, aluminum), which plate is appropriately deformed so as to define a hollow V-shaped wall which respectively defines the bottom walls 32 and 23 of the respective front and rear legs 21 and 20, with these bottom walls 32 and 23 then being bent through angles of about 180° so as to terminate in the respective top walls 31 and 22 which terminate short of one another so as to define the mouth 26 therebetween, which mouth 26 in turn communicates with the slots 34 and 25 defined between the spaced top and bottom walls of the respective rail legs 21 and 20.

FIG. 3 illustrates one type of accessory which may be utilized with the support rail assembly 14 according to the invention. The accessory illustrated in FIG. 3 is a document support tray 64 having a generally flat base or bottom wall 65, a pair of generally upright side walls 66 (only one of which is shown in FIG. 3), and a generally upright rear wall 70. Bottom wall 65 projects forwardly from rear wall 70 and terminates at a front edge portion 70A which dips slightly downwardly relative to the remainder of bottom wall 65.

With reference to FIG. 4, to secure the document support tray 64 to the support rail 16, the tray 64 has a mounting flange 71 associated with bottom wall 65 substantially centrally thereof. The flange 71 is spaced downwardly from bottom wall 65 by a small distance, and the flange 71 at one end (the forward end) is joined to the bottom wall 65 by an offset portion or leg 72 which extends generally vertically therebetween. The other or rearward end of the flange 71, as well as the side edges of the flange 71 are free of direct connection to the bottom wall 65 so that the flange 71 is cantilevered rearwardly from the offset portion 72 and thus functions similar to a stiff but resilient plate spring. The flange 71, adjacent the free end thereof, is provided with a raised rib 73 (or a detent channel) so as to create a detent-type engagement with the rib 30 of rear rail leg 20 when the support tray 64 is mounted on the support rail 16 as discussed in further detail herebelow.

Document support tray 64 may be constructed of a rigid but lightweight material and may be injection molded of a plastic material such as ABS, PP, or HDPE.

The document support tray 64 can be desirably supported on the support rail 16 by horizontally sliding the mounting flange 71 into the slot 25 of the rear rail leg 20 via mouth 26 so that the bottom wall 65 of the support tray 64 is securely and stably seated on the upper surface of the top wall 22, with this latter wall 22 being securely held between the bottom wall 65 and the mounting flange 71. The bottom wall 65 is properly positioned and seated on the support rail 16 when the mounting flange 71 is fully inserted into the slot 25 so that the front free edge of the top wall 22 substantially abuts the offset portion 72 and at the same time the rail rib 30 is located forwardly of the rib 73 so as to prevent accidental forward separation of the document support tray 64 from the support rail 16. As illustrated in FIG. 3, by positioning the flange 71 in the rear rail slot 25, the support tray 64 is oriented generally horizontally so as to permit, for example, stacking of documents thereon. Further, the support tray 64 can be readily positioned longitudinally along the rail 16 at any position convenient to the worker, for example by sliding same along the lengthwise extent of rail 16, or by removing the tray 64 and reinstalling same at the desired longitudinal position on rail 16 in the manner discussed above.

The support tray 64 may be rotated approximately 180° from the position illustrated in FIG. 3 to the position as indicated in dotted lines therein. More specifically, the support tray 64 may be supported on the upper surface of the front leg top wall 31 by fully inserting the mounting flange 71 into the front rail slot 34 so that the rear or upper edge of top wall 31 substantially abuts the offset portion 72 and at the same time the rib 35 of top wall 31 is located rearwardly or upwardly of rib 73. By positioning the mounting flange 71 in the front rail slot 34, the support tray 64 is oriented so as to angle upwardly and rearwardly away from the worker. This orientation of the support tray 64 is advantageous for supporting a document or documents (i.e., so that the lower edges thereof are supported on wall 70) so as to provide visual access to a document or other item supported on tray 64 from the vantage point of the worker who will typically be seated adjacent the front edge of the worksurface 11.

It will be appreciated that the above-discussed support tray 64 is presented only as an example of one type of accessory which may be mounted on the support rail 16, and other types of accessories may be utilized with the rail 16, provided that the accessory includes thereon a mounting member having a configuration capable of cooperation with the front and/or rear rail slots 34 and 25. Examples of such accessories usable in accordance with the invention are described in detail in copending application Ser. Nos. 09/304161; 09/304166; 09/304163; and 29/104256, each of which is being filed concurrently herewith, respectively entitled "SLOTTED DIVIDER ARRANGEMENT" (Atty. Ref.: Haworth Case 274); "GRIP CLIP" (Atty. Ref.: Haworth Case 275); and "RAIL-MOUNTED HANGING FILE ARRANGEMENT" (Atty. Ref.: Haworth Case 276); and "IN-OUT PAPER TRAY" (Atty. Ref.: Haworth Case 281), the disclosures of which are hereby incorporated by reference herein in their entirety.

Figure 8:
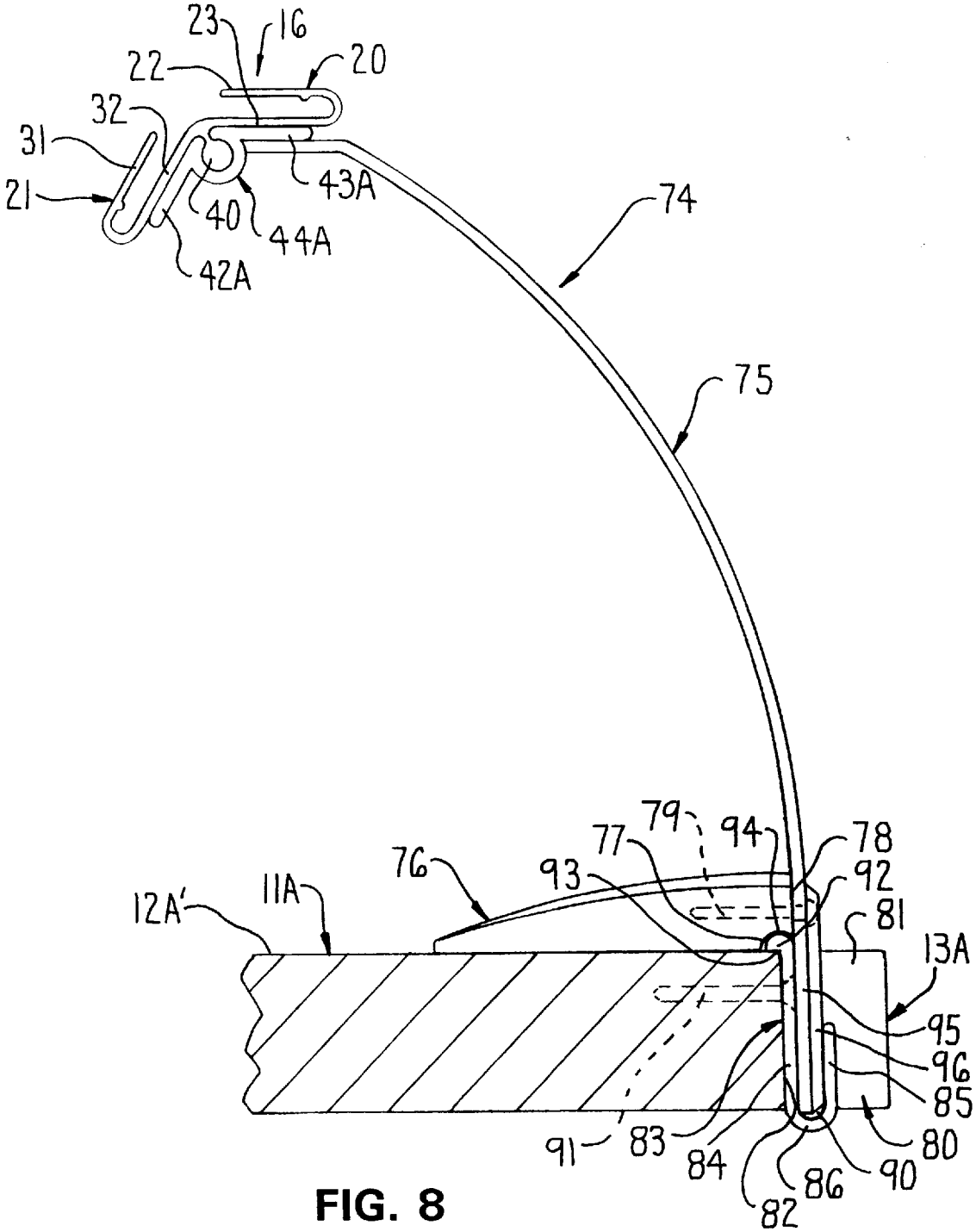
FIG. 8 is a fragmentary, sectional end elevational view of a modification of the support arm and mounting arrangement therefor.

FIG. 8 illustrates a variation of a support arm for supporting the rail 16 in upwardly spaced relation along the rear edge of a worksurface 11A. The same reference numbers are utilized in FIG. 8 for components identical to those discussed above, and similar components to those discussed above are identified with the same reference numbers plus an "A". The support arm or stanchion 74 shown in FIG. 8 includes a main tower or body part 75 having a lower and generally horizontally extending base portion 76 which bears upon and is supported by the upper surface 12A' of the worksurface 11A. Base portion 76 defines therein a downwardly opening, generally semi-circular recess 77 adjacent the rear edge 78 thereof for a purpose as discussed below. Further, base portion 76 is secured to main body part 75 via a threaded fastener 79 which extends into base portion 76 from the rear edge 78 thereof.

The uppermost end of main body part 75 is essentially identical to the upper end of the support arm 15 illustrated in FIGS. 1–5 and cooperates with the support rail 16 in an essentially identical manner. That is, main body part 75 includes front and rear support plates 42A and 43A which are angled with respect to one another and supportingly bear directly under the rail bottom walls 32 and 23, respectively. Main body part 75 also includes a guide tube 44A for cooperation with mounting rod 40 of rail 16.

The rear edge 13A of worksurface 11A (which worksurface is illustrated in cross-section in FIG. 8) has a recess 80 which extends inwardly toward the front edge of the worksurface 11A for a purpose as discussed below. Recess 80 is defined by a pair of opposed edge walls 81 (only one of which is shown in FIG. 8) and an elongate edge wall 82 which extends therebetween. This recess 80 may have a generally rectangular configuration when viewed from above, or may have other configurations such as an arcuate configuration. An elongate support bracket 83 extends longitudinally along and overlies the edge walls 81 and 82 along substantially the entire lengthwise extent of rear edge 13A. Bracket 83 has a generally J-shaped cross-section defined by front and rear walls 84 and 85 which are joined at their lower edges by a curved edge wall 86. Front and rear walls 84 and 85 along with edge wall 86 define an upwardly and sidewardly opening channel 90 which extends along the lengthwise extent of support bracket 83. The support bracket 83 is secured to worksurface 11A via a plurality of threaded fasteners such as screws 91 which extend through corresponding holes in the front wall 84 provided in suitable locations along the lengthwise extent thereof.

The uppermost terminal end of front wall 84 in the illustrated embodiment includes a lug 92 having a lower and generally flat surface 93 which bears upon the upper surface 12A of worksurface 11A, and an upper rounded surface 94 which engages in recess 77 of base portion 76. Preferably, the lug 92 extends along the entire lengthwise extent of support bracket 83 so that the support arm 74 can be mounted at any desirable longitudinal location along rear edge 13A.

The main body part 75 in the illustrated embodiment has a generally arcuate configuration when viewed from one end thereof so that same projects forwardly of the rear edge 13A of the worksurface 11A. Main body part 75 additionally includes a lowermost terminal end part 95 which mounts thereon one or more vertically extending and spaced apart ribs 96. The main body part 75 is secured to the worksurface 11A via the terminal end part 95 and ribs 96 which project downwardly into channel 90 between front and rear walls 84 and 85. The support bracket 83 is preferably constructed of a rigid extruded material, such as aluminum, and the width of channel 90 (in a front-to-back direction of worksurface 11A) is somewhat less than the combined thicknesses of the end part 95 and ribs 96 so that an interference-type fit is achieved when the lower end part 95 of main body part 75 is inserted into channel 90. Thus, to install the support arm 74 on the rear edge 13A of the worksurface 11A, the support arm 74 is lowered toward worksurface 11A and recess 77 of base portion 76 is positioned over lug 92 to engage same therein while simultaneously inserting the end part 95 and ribs 96 fully into channel 90.

As shown in FIG. 8, the mounting arrangement (including the lower end part 95 and ribs 96 of main body part 75 and support bracket 83) projects rearwardly only partially into recess 80 of the worksurface 11A, so that cabling or wiring associated with various work-related items such as a computer or telecommunication equipment can be fed downwardly through recess 80, i.e. rearwardly of rear wall 85 of support bracket 83. In this regard, it is thus possible to position the rear edge 13A of worksurface 11A immediately adjacent a wall, if desirable or necessary, while still providing an access opening through which cables can pass. The same is true if the worksurface 11A is of a type which mounts directly to a wall panel of a conventional space-dividing panel system.

It will be appreciated that the limited rearward projection of support arms 15 and 74 and also the associated mounting arrangements allows the support rail assembly according to the invention to be utilized either with a worksurface having a rear edge which lies closely adjacent a wall, or with a worksurface which is attached to a panel of a conventional space-dividing panel system. In addition, the mounting arrangements associated with the support arms 15 and 74 enable mounting of same from above and below the worksurface, which is particularly advantageous since the space between the rear edge of the worksurface and the associated wall or panel is often limited (and can typically be one inch or less), and this thus avoids having to move the worksurface away from the adjacent wall, or having to disconnect the worksurface from a panel. For example, with regard to the arrangement illustrated in FIGS. 1–7, the vertical leg 54 can be slid downwardly between the rear edge 13 of the worksurface 11 and an adjacent wall 10 (FIG. 3) and the fastening member 61 can then be tightened from below the worksurface 11. With regard to the arrangement illustrated in FIG. 8, the support arm 74 is simply lowered toward the worksurface 11A from above until the lower end thereof is seated in bracket 83.

The support arms 15 and 74 discussed above may be constructed of a rigid material such as metal, for example, aluminum.

Figure 9:
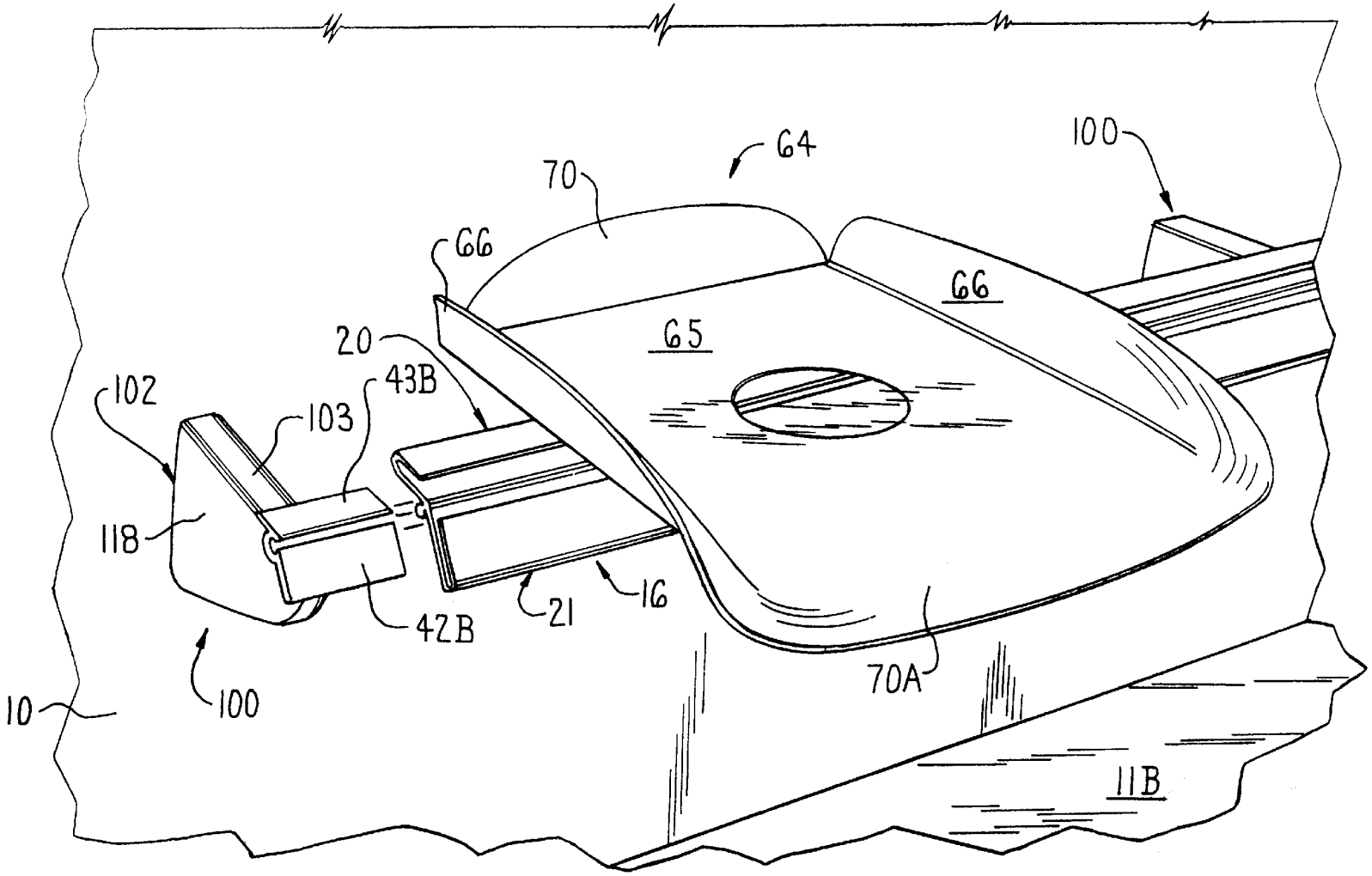
FIG. 9 is a perspective view of a further modification of the invention including a wall-mountable support rail assembly which illustrates a fragment of a horizontally enlarged worksurface and an adjacent wall.
Figure 10:
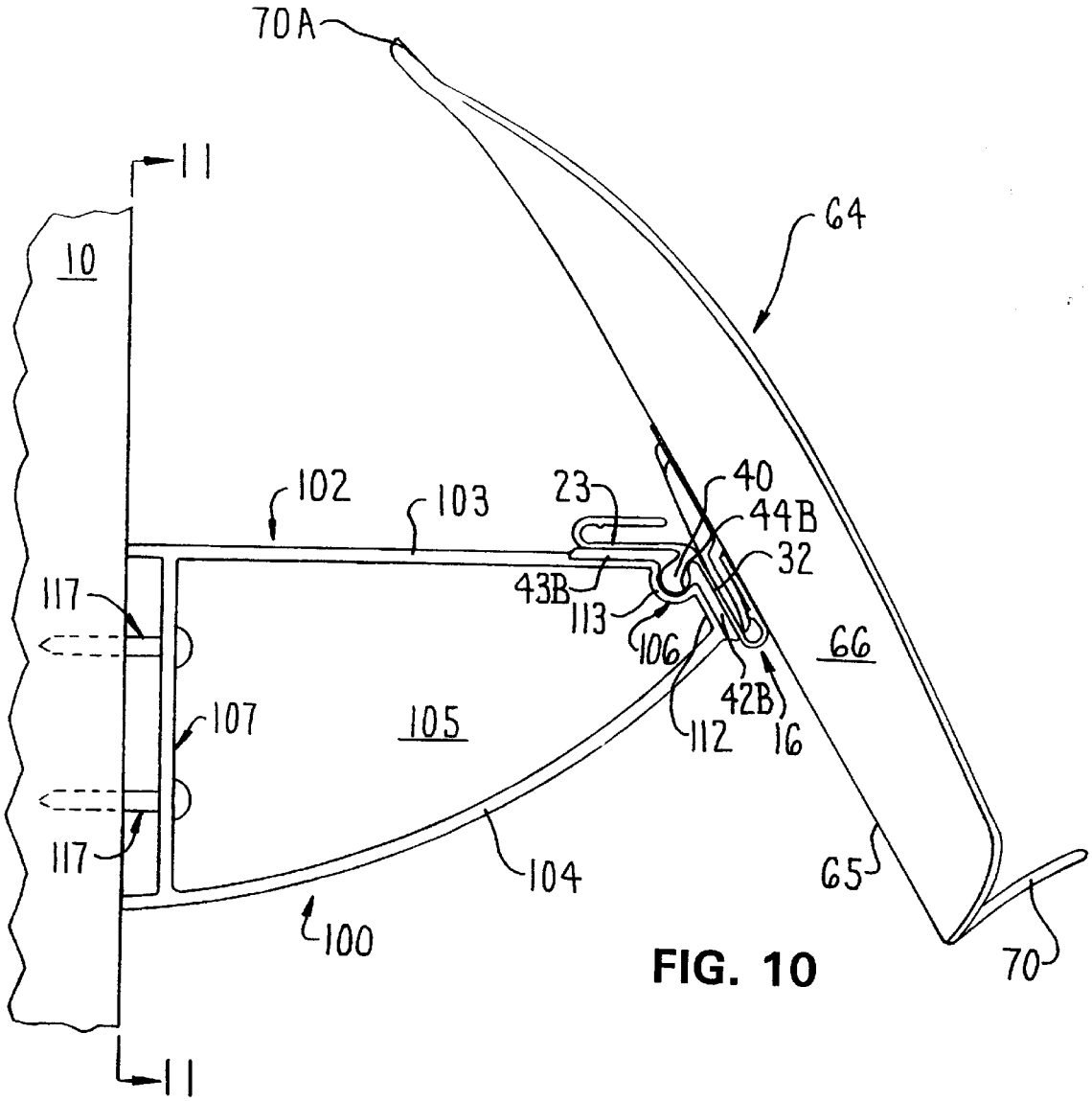
FIG. 10 is a fragmentary end elevational view of the wall-mountable support rail assembly of FIG. 9 with the arm cover removed.
Figure 11:
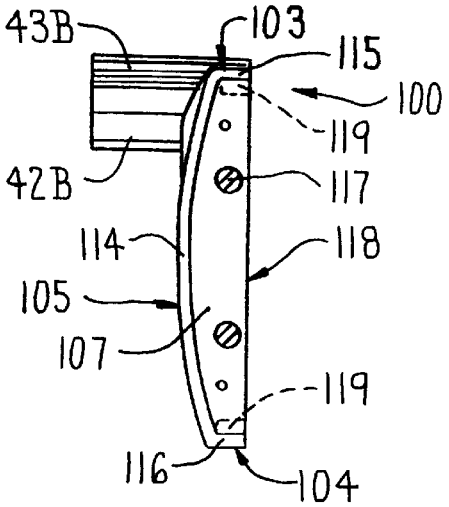
FIG. 11 is a view of the wall-mountable support rail assembly taken generally along line 11—11 in FIG. 10 and including the arm cover.

FIGS. 9–11 illustrate a further variation of the support arm according to the invention, which includes a support arm or stanchion 100 for supporting the rail 16 in upwardly spaced relation along the rear edge of the worksurface 11B, which support arm 100 is mountable in a cantilevered manner from a wall 10 positioned adjacent the worksurface 11B. The same reference numbers are utilized in FIGS. 9–11 for components identical to those discussed above, and similar components to those discussed above are identified with the same reference numbers plus a "B".

The support arm 100 includes a main body 102 which is cantilevered outwardly from wall 10. The main body 102 includes a generally flat top wall 103 which extends in a generally horizontal manner, a bottom wall 104 having a generally arcuate configuration which curves upwardly as it projects forwardly from the wall 10, a side wall 105, and front and rear walls 106 and 107 which extend between and interconnect the top, bottom and side walls.

The forward end of support arm 100 is essentially identical to the upper end of support arm 15 illustrated in FIGS. 2–5 and cooperates with the support rail 16 in an essentially identical manner. That is, the forward end of support arm 100 mounts thereon front and rear support plates 42B and 43B which are angled with respect to one another and supportingly bear directly under the rail bottom walls 32 and 23, respectively. Rear support plate 43B is positioned on top wall 103, and front support plate 42B is positioned along a lower angled portion 112 of front wall 106. Guide tube 44B interconnects front and rear support plates 42B and 43B and is secured to an outwardly opening and generally concave portion 113 of front wall 106 for cooperation with mounting rod 40 of rail 16.

The rear wall 107 of support body 102 in the illustrated embodiment is positioned inwardly of the rear edges 114, 115 and 116 of the respective side top and bottom walls 105, 103 and 104, and includes holes therein for receiving threaded fasteners 117, such as screws (FIGS. 10 and 11). The fasteners 117 in the illustrated embodiment are inserted into the wall 10 from the outwardly facing side of rear wall 107 so as to fixedly secure the support arm 100 to wall 10. Other types of fastenings may be utilized to secure the support arm 100 to the wall 10, and the above is presented as an example of one type of fastening which may be utilized.

To provide the support arm 100 with a finished appearance, an arm cover 118 may be provided as shown in FIGS. 9 and 11. Cover 118 may be provided with a ring-like flange 119 which engages with the inwardly facing surfaces of the top, bottom front and rear walls to secure cover 118 to arm 100.

With reference to FIG. 9, one or more support arms 100 may be mounted along the wall 10 to support the rail 16. The rail 16 is mounted on the support arms 100 in a similar manner as that discussed above with regard to the worksurface mounted support arms, and is usable with the document support tray 64 and other office-type accessories. In this regard, the support arm 100 preferably projects forwardly from the wall 101 a sufficient distance so as to permit the horizontal mounting of an accessory such as document support tray 64, for example as shown in FIG. 9. Alternatively, as shown in FIG. 10, the document support tray 64 may be rotated 180° and mounted so as to angle upwardly and away from the user typically positioned adjacent the front edge of the worksurface 11B.

Figure 12:
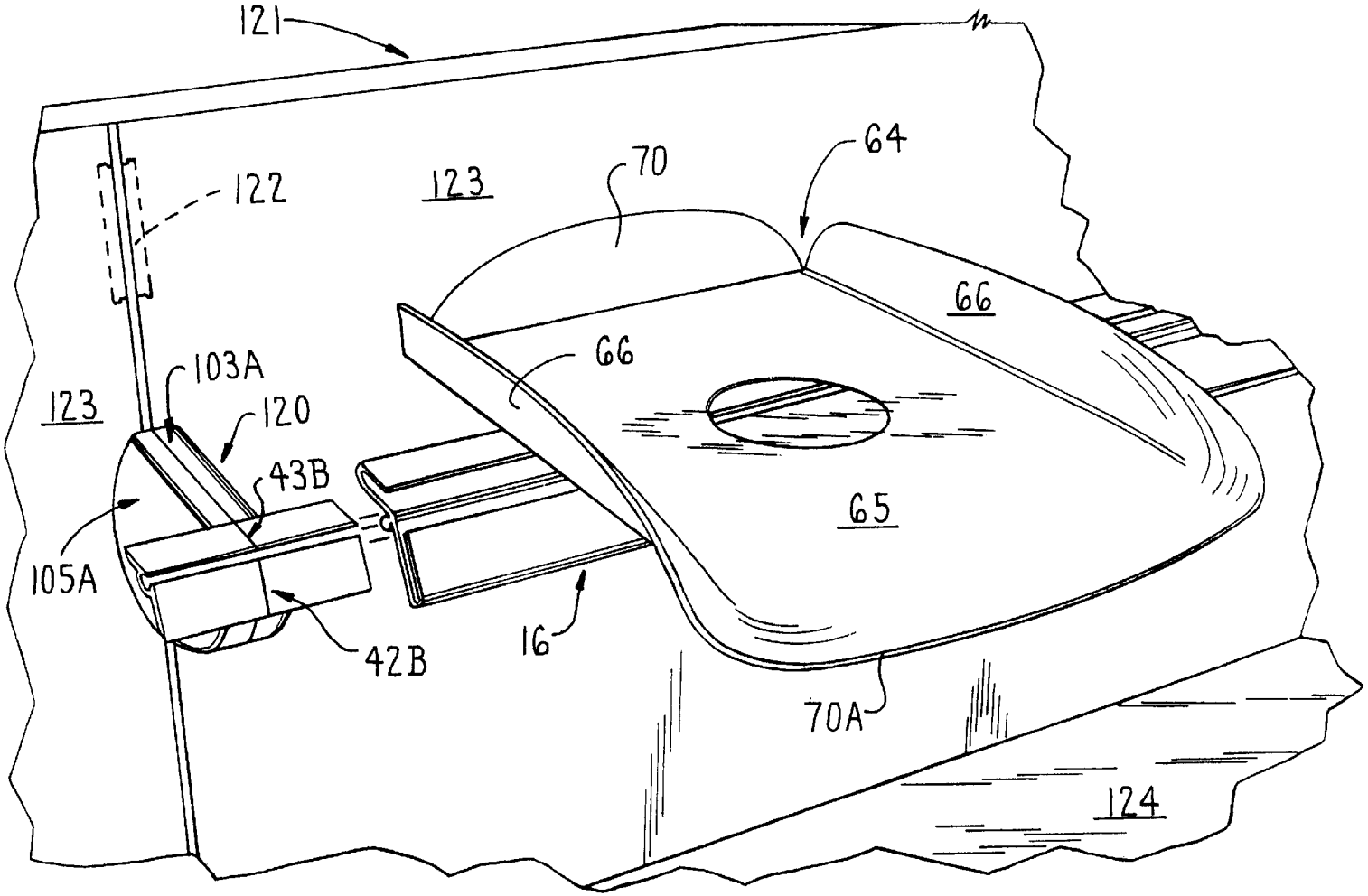
FIG. 12 is a perspective view of a further modification of the invention including a wall panel-mountable support rail assembly which illustrates a fragment of a horizontally enlarged worksurface and an adjacent upright panel.

FIGS. 12–15 illustrate an additional variation of a support arm 120 according to the invention, which support arm 120 is adapted for use with conventional panel-type space dividing systems 121 typically used to define individual work areas in an office-type environment. Components shown in FIGS. 12–15 which are similar to components discussed above have the same reference numbers plus an "A". FIG. 12 shows the support arm 120 mounted in a cantilevered manner from an upright post 122 (shown in dotted lines in FIG. 12) which is utilized to join two adjacent and upright panel members 123. The support arm 120 supports the rail 16 in upwardly spaced relation along the rear edge of a worksurface 124 which will typically be attached to at least one of the panel members 123.

The support arm 120 illustrated in FIGS. 12–15 is a two-piece component constructed of left and right vertical halves which are mirror images of one another, and which right half corresponds to the support arm 100 depicted in FIGS. 9–11. More specifically, the two vertical halves of support arm 120 are arranged and suitably fastened together so that the inner side edges abut one another to define top, bottom, front and rear walls 103A, 104A, 106A and 107A, respectively, with a pair of upright side walls 105A extending therebetween. The top, bottom, front, rear and side walls together define a generally hollow interior. The forward end of support arm 120 is essentially identical to the forward end of support arm 100 and cooperates with rail 16 in an essentially identical manner.

Figure 13:
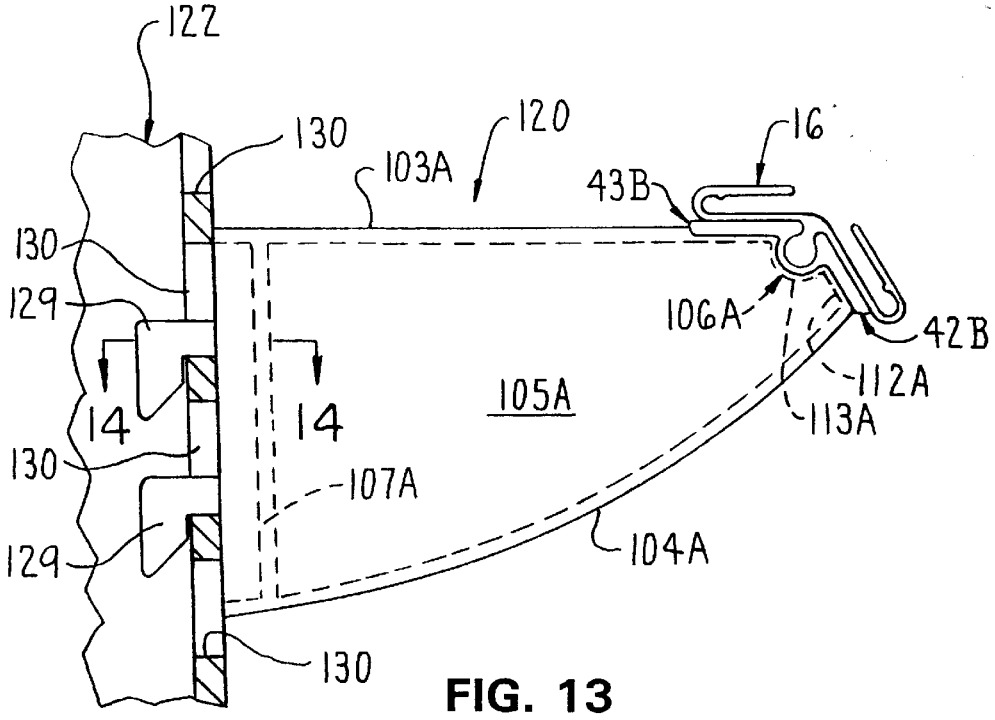
FIG. 13 is an end elevational view of the panel-mountable support rail assembly of FIG. 12 which illustrates a connector post of a wall panel system in cross-section.
Figure 14:
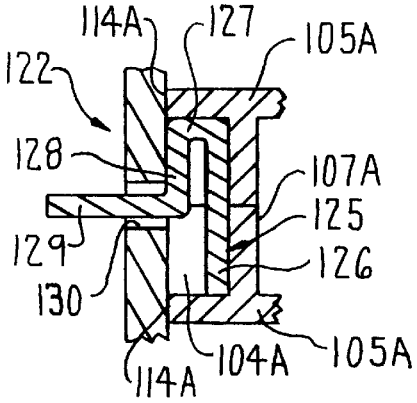
FIG. 14 is a fragmentary cross-sectional view taken generally long line 14—14 in FIG. 13.

To securely but removably mount the support arm 120 to the post 122, a support bracket 125 is provided which is mounted in a generally upright manner to rear wall 107A (FIGS. 13 and 14). Support bracket 125 in the illustrated embodiment is preferably constructed of a rigid material such as metal, and includes: a front leg part 126 which overlies the rear wall 107A; a side leg part 127 joined to one end of front leg part 126 and projecting rearwardly therefrom in a generally perpendicular manner; a rear leg part 128 which projects from a rear end of side leg part 127 and is spaced from and generally parallel to front leg part 126; and a pair of vertically aligned hooks 129 which project rearwardly from rear leg part 128 and are generally perpendicular thereto. Front leg part 126 is securely attached by screws or other fasteners (not shown) to rear wall 107A. The hooks 129 engage within corresponding slots 130 formed within the connector post 122, which slots 130 are typically utilized to mount accessories such as shelves and extend in a vertical row along opposite sides of the connector post 122. One example of a space-dividing panel system which utilizes such connector posts is disclosed in U.S. Pat. No. 5,377,466, entitled "SEPARABLE POST/PANEL SYSTEM", and also U.S. patent application Ser. No. 09/185,689 entitled "POST-PANEL CONNECTOR ARRANGEMENT", both of which are incorporated by reference herein in their entirety.

To assemble the support arm 120 on the connector post 122, the hooks 129 are aligned with the slots 130 in post 122 and inserted thereinto, and the support arm 120 is then lowered so as to allow the hooks 129 to engage the lower end of slots 130. The rail 16 is mounted on forward end of support arm 120 in an essentially identical manner as discussed above.

The rigid and sturdy construction of the support arm 120 allows the use of a single support arm 120 for supporting the rail 16, which is advantageous since there is typically limited space associated with work areas defined by space-dividing panel systems. In this regard, rails 16 of varying lengths may be utilized depending upon the space requirements of the work area in accordance with this embodiment, and also the above-discussed embodiments. For example, rail lengths of approximately 24 to 30 inches or less may be supportable by a single worksurface-mounted support arm 15, 74, or a single wall-mounted support arm 100, 120, while rails of a greater length than about 30 inches would typically require two or more support arms.

Figure 15:
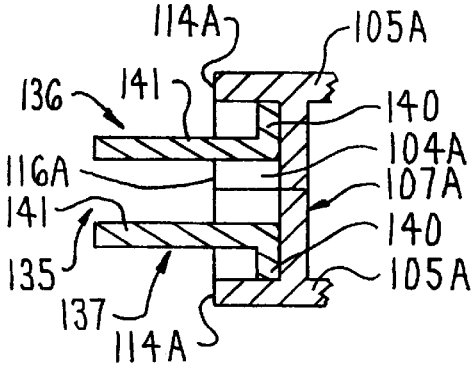
FIG. 15 is a fragmentary cross-sectional view similar to FIG. 14, but illustrating a modified support bracket.

FIG. 15 illustrates a modified support bracket which may be utilized with space-dividing panel systems in which the slots for mounting office accessories are located vertically along the edge rails which define the respective upright end edges of each panel member. One example of this type of panel system is disclosed in U.S. Pat. No. 3,990,204 entitled "ALIGNMENT SYSTEM FOR WALL PANELS", which is incorporated by reference in its entirety herein. The upright edge rails of two adjacent panel members are typically connected to one another via an elongate fastening member and the adjacent edge rails, and thus the respective vertical rows of accessory slots, are spaced-apart from one another by a small distance. To accommodate this type of panel arrangement, the support bracket arrangement 135 depicted in FIG. 15 is embodied by a pair of generally L-shaped support members 136 and 137. The support members 136 and 137 each have a forward leg 140 which overlies rear wall 107A and is securely fastened thereto, and a pair of vertically aligned hooks 141 (essentially identical to hooks 129) which project outwardly from the inner end of the respective forward leg 140. The hooks 141 of support member 136 engage within correspondingly located slots (not shown) in the edge rail of a panel member, and the hooks 141 of the support member 137 engage in the mating edge rail of an adjacent panel member. Thus, the support arm 120 including support brackets 136 and 137 mounted thereon is assembled to the panel members by aligning the hooks 141 with the corresponding slots in the adjacent upright edge rails, and then lowering the support arm 120.

With regard to both types of support brackets 125 and 135 discussed above, if a particularly lengthy rail 16 is desirable or necessary, it will be appreciated that additional support arms 120 may be utilized to support same, and may be mounted on adjacent upright connector posts 122 utilizing support bracket 125 in the manner described above, or alternatively the support arms 120 may be mounted on adjacent pairs of edge rails of mating panel members utilizing support bracket arrangement 135.

It will be appreciated that the support arm 100 illustrated in FIGS. 10 and 11 may alternatively be provided with hooks similar to hooks 129 and 141 for mounting on a panel member as discussed above, and one or more of such support arms may be provided to support the rail 16.

Further, it will be appreciated that the support arms 100 and 120 depicted in FIGS. 9–15 may be constructed of a rigid, lightweight metal, such as aluminum. In addition, the support arm 120 shown in FIGS. 12–15 in the illustrated embodiment is constructed of mating, mirror-image halves as discussed above, however, the support arm 120 may instead be constructed as a one-piece member.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. An office accessory arrangement for use with a worksurface having an enlarged upper surface, said arrangement comprising:

an elongate support rail stationarily positionable above the worksurface and extendible generally along a longitudinal edge thereof, said support rail defining therein a pair of slots disposed in angled relation with one another, said slots communicating with one another and opening outwardly via a common access opening defined in a peripheral wall of said support rail; and an accessory supported entirely on said support rail so as to be free of supportive engagement with the worksurface, said accessory having a mounting part which projects into only one of said slots to releasably secure said accessory to said support rail, whereby the angled relation of said slots permits said accessory to be disposed in different positions relative to the worksurface and permits mounting of different accessories on said support rail.

2. The arrangement of claim 1 wherein said slots and said access opening extend along substantially the entire lengthwise extent of said support rail such that said accessory is positionable at any desirable location therealong.

3. The arrangement of claim 1 wherein said peripheral wall of said support rail defines front and rear legs each defining one of said slots therein, said front and rear legs each including a pair of opposed and spaced-apart top and bottom walls connected to one another by an edge wall extending therebetween, said edge wall of said front leg defining a forwardmost extent of said support rail and said edge wall of said rear leg defining a rearward most extent of said support rail, said top, bottom and edge walls of the respective front and rear legs together defining the respective said slot.

4. The arrangement of claim 3 wherein said access opening is defined by adjacent and opposed free edges of said top walls of said front and rear legs.

5. The arrangement of claim 1 wherein said accessory comprises a document support tray having a base wall, and said mounting part includes a stiff but resiliently deflectable flange which is secured to and cantilevered downwardly from said base wall for projection into one of said pair of slots.

6. The arrangement of claim 5 wherein said mounting part includes a generally vertically oriented leg part which projects downwardly from said base wall and is connected at a lower end thereof to said flange to space said flange downwardly from said base wall.

7. The arrangement of claim 1 further including a pair of support arms connectable to the worksurface adjacent a rear edge portion thereof, said support rail being slidably engageable on upper ends of the respective support arms to stationarily position said support rail above the worksurface and generally along the rear edge portion thereof.

8. The arrangement of claim 7 wherein said support rail mounts thereon an elongate mounting member which extends in the longitudinal direction of said support rail along substantially the entire longitudinal extent thereof and the respective support arms each include a receiving member defining therein a channel for slidably receiving said mounting member, each said channel being open at opposite ends thereof, and said elongate mounting member being slidably and sidewardly insertable into said channels of the respective support arms through respective open ends thereof to releasably but fixedly secure said support rail to said support arms.

9. An office accessory arrangement for use with a worksurface having an enlarged upper surface, said arrangement comprising:

an elongate support rail stationarily positionable above the worksurface and extendible generally along a longitudinal edge thereof, said support rail defining therein a pair of slots in communication with one another and which open outwardly via a common access opening defined in a peripheral wall of said support rail, said peripheral wall of said support rail defining front and rear legs each defining one of said slots therein, said rear leg and the respective slot projecting generally horizontally and said front leg and the respective slot projecting forwardly and angling downwardly from a junction with said rear leg such that said front and rear legs together define a downwardly-opening, shallow V-shape configuration with said access opening extending longitudinally along said junction; and entirety rail so as to be free of supportive engagement with the worksurface, said accessory having a mounting part which projects into one of said slots to releasably secure said accessory to said support rail.

10. The arrangement of claim 9 wherein said front and rear legs and the respective slots together define an included angle of greater than 90° such that said accessory is positionable in either a generally horizontal orientation upon said mounting part thereof being inserted into said slot of said rear leg or in an angled position upon said mounting part thereof being inserted into said slot of said front leg.

11. A support rail assembly for use with a worksurface having an enlarged upper surface, a front edge portion adjacent a user and a rear edge portion remote from the user, said assembly comprising:

an elongate support rail having longitudinally extending front and rear edges and a pair of free end edges extending transversely relative to said front and rear edges, said support rail being adapted for mounting an accessory thereon; and a support arm connectable to the worksurface adjacent the rear edge portion thereof for stationarily positioning said support rail above the worksurface and generally along the rear edge portion thereof, one of said support rail and said support arm mounting thereon an elongate mounting member which extends in the longitudinal direction of said support rail and projects in a direction transverse relative thereto and the other of said support rail and said support arm defining therein a channel for slidably receiving said elongate mounting member, said channel being open at opposite ends thereof generally adjacent said free end edges of said support rail such that said elongate mounting member is slidably and sidewardly insertable into said channel through one of said open ends such that said support arm is slidably positionable along the longitudinal extent of said support rail.

12. The assembly of claim 11 wherein said support rail has a bottom portion having said elongate mounting member projecting generally downwardly therefrom, and said support arm has an upper end having a mounting plate secured thereto, said channel extending transversely across said mounting plate and said mounting plate being in supportive engagement with said bottom portion of said support rail.

13. The assembly of claim 12 wherein said elongate mounting member includes a rod-shaped portion and an elongate rib extending along the length of said rod-shaped portion for mounting said rod-shaped portion to said bottom portion, said rib having a smaller cross-sectional size than said rod-shaped portion, said channel opening upwardly through an access opening having a smaller cross-sectional size than said channel, said rod-shaped portion being slidably disposed within said channel and said rib extending downwardly through said access opening to secure said support rail to said support arm.

14. The assembly of claim 11 wherein said support rail includes front and rear legs each defining a longitudinally extending slot therein for mounting an accessory on said support rail, said rear leg and the respective slot projecting generally horizontally and said front leg and the respective slot projecting forwardly and angling downwardly from a junction with said rear leg such that front and rear legs together define a shallow V-shape configuration.

15. The assembly of claim 14 wherein said front and rear legs each include opposed and spaced-apart top and bottom walls connected to one another by an edge wall extending therebetween, said edge wall of said front leg defining said front edge of said support rail and said edge wall of said rear leg defining said rear edge of said support rail, said top, bottom and edge walls of the respective front and rear legs together defining the respective slot, said slots communicating with one another and opening outwardly via a common access opening for permitting mounting of the accessory on said support rail, said access opening being defined between adjacent and opposed longitudinally extending free edges of said top walls of said front and rear legs.

16. The assembly of claim 14 wherein said support arm has an upper end mounting thereon front and rear mounting plates disposed on opposite sides of said channel, said channel opening upwardly through an access opening defined between inner opposed longitudinal edges of said mounting plates, said front and rear mounting plates being respectively disposed in supportive engagement with said front and rear legs of said support rail.

17. The assembly of claim 11 wherein said support rail is releasably fastened to an upper end of said support arm, said support arm having a lower end which is adapted to bear upon the upper surface of the worksurface, said assembly further including a generally L-shaped mounting element for securing said support arm and said support rail to the rear edge portion of the worksurface, said mounting element having a first leg which is adapted to overly the rear edge portion of the worksurface and a second leg fixed to a lower end of said first leg for projecting partially under the worksurface.

18. The arrangement of claim 1 further including a support arm having a forwardmost end mounting said support rail thereon, said support arm including a mounting arrangement at a rearwardmost end thereof adapted for securing said support arm to an upright wall member disposed closely adjacent the longitudinal edge of the worksurface.

19. The arrangement of claim 18 further including a support bracket fixed to said rearwardmost end of said support arm, said support bracket including at least one hook projecting outwardly therefrom for engagement within a slot formed in a rigid upright member of a space-dividing wall panel system.

20. The assembly of claim 11 wherein said support rail is releasably fastened to an upper end of said support arm, said assembly further including a mounting arrangement for removably mounting said support arm to the rear edge portion of the worksurface, said mounting arrangement including a base portion fixed to a lower end of said support arm which bears upon the upper surface of the worksurface and an elongate bracket adapted for connection longitudinally along the rear edge portion and defining an upwardly opening channel, said mounting arrangement further including a generally vertically-oriented mounting part fixed to said base portion and overlying the rear edge portion of the worksurface, said mounting part being snugly engaged within said channel of said bracket to secure said support arm to the worksurface.

21. The assembly of claim 11 wherein said mounting member projects transversely and generally downwardly from a lower portion of said support rail and extends along substantially the entire longitudinal extent thereof, said channel is defined in an upper end of said support arm, and said support arm is slidably positionable between said free end edges of said support rail and supports said support rail from a lower side thereof.

22. The assembly of claim 21 further including a pair of said support arms connectable to the worksurface adjacent the rear edge portion thereof, said support arms being slidably positionable along the longitudinal extent of said support rail between said free end edges thereof.

23. A support rail assembly for use with a worksurface having an enlarged upper surface, a lower surface opposite said upper surface, a front edge portion adjacent a user and a rear edge portion remote from the user, said assembly comprising:

an elongate support rail adapted for mounting an accessory thereon;

an upright support arm having an upper end releasably connected to said support rail for stationarily positioning the support rail above the worksurface and generally along the rear edge portion thereof and a lower end for bearing upon the upper surface of the worksurface, said support arm defining thereon a rear upright surface disposed between said upper and lower ends for facing away from the front edge portion of the worksurface;

a mounting arrangement for securing said support arm and said support rail to the worksurface, said mounting arrangement including:

a mounting flange having a first leg portion which overlies at least part of said rear surface of said support arm and a second leg portion fixed to said first leg portion and projecting in a generally horizontal manner from a lower end thereof for extension under the worksurface, said first leg portion defining therein at least one slot;

at least one pin member projecting generally outwardly from said rear surface for engagement within said one slot; and a fastening member associated with said second leg portion and being adjustable to exert a generally downwardly directed force on said first leg portion so as to wedge said one pin in said one slot and fixedly but releasably secure said support arm and support rail to the worksurface.

24. The support rail assembly of claim 23 wherein said fastening member threadingly engages with said second leg portion and has an upper end for engagement with the lower surface of the worksurface and a lower end configured for gripping by a hand or tool, said fastening member being manually rotatable to bring said upper end thereof into clamping engagement with the lower surface of the worksurface and to wedge said one pin in said slot.

25. The support rail assembly of claim 23 wherein said second leg portion is adapted to be spaced horizontally downwardly from the lower surface of the worksurface.

26. The support rail assembly of claim 23 wherein said support arm and said first leg portion have generally arcuate configurations so as to project forwardly from the rear edge portion of the worksurface toward the front edge portion thereof, said mounting flange having a minimal thickness to permit downward projection of said mounting flange between the rear edge portion of the worksurface and a wall member positioned closely adjacent the rear edge portion.

27. The support rail assembly of claim 23 wherein said support arm includes a pair of generally parallel flanges spaced-apart from one another and extending along opposite longitudinal edges of said rear surface so as to project outwardly therefrom, said flanges and said rear surface together defining an upwardly opening and generally U-shaped recess configured to receive said first leg portion.

28. A combination comprising:

a worksurface having longitudinally extending front and rear edges and defining thereon an enlarged upper surface;

a horizontally elongated support rail having a length defined between a pair of free terminal ends thereof, said support rail defining a pair of slots in communication with one another and opening outwardly and frontwardly of said support rail via a common access opening which is disposed opposite a mounting element, said mounting element projecting transversely and rearwardly from said support rail and extending longitudinally along a substantial portion of said length thereof;

an office-type accessory supported entirely on said support rail so as to be free of supportive engagement with the worksurface, said accessory having a mounting part which projects into one of said slots via said access opening to releasably secure said accessory to said support rail; and a support arm disposed adjacent the rear edge of the worksurface for stationarily positioning said support rail above the worksurface so as to extend generally along the rear edge thereof, said support arm including a mounting part defined on an upper end thereof which slidably receives said mounting element of said support rail, said support arm being positioned between said free terminal ends of said support rail; and a mounting arrangement for removably mounting said support arm adjacent the rear edge of the worksurface.

29. The combination of claim 28 wherein said mounting part of said support arm comprises a plate defining a channel therein which opens both outwardly in a direction transverse to the longitudinal direction of said support rail and sidewardly generally adjacent each of the respective free terminal ends of said support rail, said mounting element projecting transversely from a lower side of said support rail and being releasably engaged within said channel and sidewardly insertable thereinto through one of said open ends thereof.

30. The combination of claim 29 further including a pair of said support arms connectable to the worksurface for stationarily positioning said support rail above the worksurface, said support arms being positioned inwardly of the respective free terminal end edges of said support rail.

31. An office accessory arrangement comprising:

an elongate support rail including front and rear legs each defining a slot therein, said slots opening outwardly via a common access opening, said front and rear legs and the respective slots being disposed in angled relation with one another such that said front and rear legs together define a shallow inverted V-shaped configuration with said access opening extending longitudinally along a junction between said front and rear legs;

an accessory having a mounting element which projects into one of said slots to releasably secure said accessory to said support rail; and a support arm for stationarily positioning said support rail along an upright wall member, said support arm having a front end which mounts said support rail thereon and a rear end securable to the wall member.

32. The arrangement of claim 31 further including a support bracket fixed to said rear end of said support arm, said support bracket including at least one hook projecting outwardly therefrom for engagement within a slot formed in a rigid upright member of a space-dividing wall panel system.

33. The arrangement of claim 31 wherein said front end of said support arm defines a channel which extends in the longitudinal direction of said support rail, and said support rail on a lower side thereof includes a transversely projecting and elongate mounting member which is slidably engageable within said channel to releasably connect said support rail to said support arm.

34. The arrangement of claim 33 wherein said front and rear legs each include opposed and spaced-apart top and bottom walls connected to one another by an edge wall extending therebetween, said edge wall of said front leg defining a front edge of said support rail and said edge wall of said rear leg defining a rear edge of said support rail, said top, bottom and edge walls of the respective front and rear legs together defining the respective slot, said access opening being defined between adjacent and opposed longitudinally extending free edges of said top walls of said front and rear legs.

* * * * *

UNITED STATES PATENT AND TRADEMARK OFFICE

CERTIFICATE OF CORRECTION

PATENT NO. : 6,267,338 B1
DATED : July 31, 2001
INVENTOR(S) : Charles Saylor et al.

It is certified that error appears in the above-identified patent and that said Letters Patent is hereby corrected as shown below:

Column 13,
Line 21, replace "entirety" with -- an accessory supported entirely on said support --.

Signed and Sealed this

Fourteenth Day of May, 2002

*Attest:*

*Attesting Officer*

JAMES E. ROGAN
*Director of the United States Patent and Trademark Office*